US009943114B2

(12) United States Patent
Batista

(10) Patent No.: US 9,943,114 B2
(45) **Date of Patent: *Apr. 17, 2018**

(54) AEROSOL-FORMING CARTRIDGE COMPRISING A TOBACCO-CONTAINING MATERIAL

(71) Applicant: PHILIP MORRIS PRODUCTS S.A., Neuchatel (CH)

(72) Inventor: Rui Nuno Batista, Morges (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/323,803

(22) PCT Filed: Jul. 9, 2015

(86) PCT No.: PCT/EP2015/065770

§ 371 (c)(1),
(2) Date: Jan. 4, 2017

(87) PCT Pub. No.: WO2016/005533

PCT Pub. Date: Jan. 14, 2016

(65) Prior Publication Data

US 2017/0164657 A1 Jun. 15, 2017

(30) Foreign Application Priority Data

Jul. 11, 2014 (EP) ..... 14176827

(51) Int. Cl.

| | |
|---|---|
| ***A24F 11/00*** | (2006.01) |
| ***A24F 47/00*** | (2006.01) |
| ***H05B 3/34*** | (2006.01) |

(52) U.S. Cl.
CPC ..... *A24F 47/008* (2013.01); *H05B 3/34* (2013.01); *H05B 2203/017* (2013.01)

(58) Field of Classification Search
CPC ..... A24F 47/008; A24F 47/002; F01K 5/00; H04Q 9/00; G08C 17/02; G08C 2201/93; H04M 1/72533; F22B 1/28
(Continued)

(56) References Cited

U.S. PATENT DOCUMENTS

| | | | |
|---|---|---|---|
| 4,989,619 | A | 2/1991 | Clearman et al. |
| 5,388,594 | A | 2/1995 | Counts et al. |

(Continued)

FOREIGN PATENT DOCUMENTS

| | | | |
|---|---|---|---|
| DE | 10 2006 041 042 | A1 | 3/2008 |
| EP | 0 271 036 | A2 | 6/1988 |

(Continued)

OTHER PUBLICATIONS

International Search Report and Written Opinion dated Oct. 2, 2015 in PCT/EP2015/065770 filed Jul. 9, 2015.

*Primary Examiner* — Phuong Chi T Nguyen
(74) *Attorney, Agent, or Firm* — Oblon, McClelland, Maier & Neustadt, L.L.P.

(57) ABSTRACT

There is provided an aerosol-forming cartridge for an electrically operated aerosol-generating system. The cartridge includes a base layer and at least one aerosol-forming substrate disposed on the base layer and including a tobacco-containing material with volatile tobacco flavor compounds that are releasable from the aerosol-forming substrate. The base layer and the at least one aerosol-forming substrate are in contact at a contact surface, which is substantially planar.

20 Claims, 7 Drawing Sheets

(58) Field of Classification Search
USPC ..... 131/328, 329
See application file for complete search history.

(56) References Cited

U.S. PATENT DOCUMENTS

| | | | | |
|---|---|---|---|---|
| 5,505,214 | A | 4/1996 | Collins et al. | |
| 5,591,368 | A | 1/1997 | Fleischhauer et al. | |
| 2008/0092912 | A1 | 4/2008 | Robinson et al. | |
| 2010/0200006 | A1 | 8/2010 | Robinson et al. | |
| 2012/0060853 | A1 | 3/2012 | Robinson et al. | |
| 2014/0360515 | A1 | 12/2014 | Vasiliev et al. | |
| 2015/0040930 | A1 | 2/2015 | Robinson et al. | |
| 2015/0047656 | A1 | 2/2015 | Robinson et al. | |
| 2017/0144827 | A1* | 5/2017 | Batista | B65D 85/54 |
| 2017/0150755 | A1* | 6/2017 | Batista | A24F 47/008 |
| 2017/0164657 | A1* | 6/2017 | Batista | A24F 47/008 |
| 2017/0181472 | A1* | 6/2017 | Batista | A24F 47/008 |

FOREIGN PATENT DOCUMENTS

| | | | |
|---|---|---|---|
| EP | 0 857 431 | A1 | 8/1998 |
| EP | 1 736 062 | A2 | 12/2006 |
| WO | WO 2007/024130 | A1 | 3/2007 |
| WO | WO 2007/066374 | A1 | 6/2007 |
| WO | WO 2007/131449 | A1 | 11/2007 |
| WO | WO 2007/131450 | A1 | 11/2007 |
| WO | 2013/034454 | A1 | 3/2013 |
| WO | WO 2013/152873 | A1 | 10/2013 |
| WO | WO 2014/004648 | A1 | 1/2014 |
| WO | WO 2014/032276 | A1 | 3/2014 |

* cited by examiner

AEROSOL-FORMING CARTRIDGE COMPRISING A TOBACCO-CONTAINING MATERIAL

The present disclosure relates to an aerosol-forming cartridge for use in an electrically operated aerosol-generating system. In particular, the present invention relates to aerosol-forming cartridges having at least one aerosol-forming substrate comprising a tobacco-containing material with volatile tobacco flavour compounds which are releasable from the aerosol-forming substrate. The present invention also relates to aerosol-generating systems comprising aerosol-forming cartridges and to methods of manufacturing aerosol-forming cartridges.

One type of aerosol-generating system is an electrically operated smoking system. Handheld electrically operated smoking systems consisting of an electric vaporiser, an aerosol-generating device comprising a battery and control electronics, and an aerosol-forming cartridge are known. Typically, aerosol-forming cartridges for use with aerosol-generating devices comprise an aerosol-forming substrate that is assembled, often with other elements or components, in the form of a rod. Typically, such a rod is configured in shape and size to be inserted into an aerosol-generating device that comprises a heating element for heating the aerosol-forming substrate. Other known aerosol-forming cartridges comprise an aerosol-forming substrate in contact, or in close proximity with an electric heater forming part of the cartridge. In one such example, the cartridge comprises a supply of liquid aerosol-forming substrate and a coil of heater wire wound around an elongate wick soaked in the liquid aerosol-forming substrate. Known cartridges typically comprise a mouthpiece portion, which the user sucks on in use to draw aerosol into their mouth.

However, known aerosol-forming cartridges are relatively expensive to produce. This is because of their complexity and the fact that their manufacture typically requires extensive manual assembly operations. Further, these cartridges often require delicate handling, or the provision of a protective outer housing, in order to avoid damage during transport.

EP-A2-0271036 provides a smoking article with a combustible heat source, an aerosol-forming substrate held in a capsule downstream of the heat source and a mouthpiece downstream of the aerosol-forming substrate. The capsule comprises a metallic tube within which is held an aerosol-forming substrate. The capsule is joined to the heat source and to the mouthpiece by cigarette papers and forms an integral part of the smoking article. Thus, the capsule cannot be uncoupled from the rest of the smoking article when the flavour source has been consumed. Instead, the entire smoking article is disposed of as one unit when the flavour source has been consumed.

US-A1-2008/092912 provides a smoking article having an aerosol-forming cartridge, containing tobacco material, which is held within an aerosol-generating device. The cartridge is rod-shaped.

It would be desirable to provide an aerosol-forming cartridge that is robust and inexpensive to produce.

According to a first aspect of the present invention, there is provided an aerosol-forming cartridge for use in an electrically operated aerosol-generating system, the cartridge comprising: a base layer; and at least one aerosol-forming substrate arranged on the base layer and comprising a tobacco-containing material with volatile tobacco flavour compounds which are releasable from the aerosol-forming substrate; wherein the base layer and the at least one aerosol-forming substrate are in contact at a contact surface which is substantially planar.

By having the base layer and the at least one aerosol-forming substrate in contact at a contact surface which is substantially planar, the cartridge can be advantageously manufactured using only vertical assembly operations. This simplifies the manufacture of the cartridge by removing the need for any more complex assembly operations, such as rotational or multi-translational movements of the cartridge or its components, as known in the manufacture of cylindrical objects, such as cigarettes. Such cartridges can also be made using fewer components than conventional cartridges and are generally more robust.

As used herein, the term "cartridge" refers to a consumable article which is configured to couple to and uncouple from an aerosol-generating device to form an aerosol-generating system and which is assembled as a single unit that can be coupled and uncoupled from the aerosol-generating device by a user as one when the article has been consumed.

As used herein, the term "aerosol-forming cartridge" refers to a cartridge comprising an aerosol-forming substrate that is capable of releasing volatile compounds that can form an aerosol. For example, an aerosol-generating cartridge may be a smoking article.

As used herein, the term 'aerosol-forming substrate' is used to describe a substrate capable of releasing volatile compounds, which can form an aerosol. The aerosols generated from aerosol-forming substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

As used herein, the term "contact" includes direct contact between two components of the cartridge, as well as indirect contact via one or more intermediate components of the cartridge, such as coatings or laminated layers.

As used herein, the term "substantially planar", means arranged substantially along a single plane.

Preferably the aerosol-forming cartridge is a heated smoking article, which is a smoking article comprising an aerosol-forming substrate that is intended to be heated rather than combusted in order to release volatile compounds that can form an aerosol.

The cartridge may have any suitable outer shape. The cartridge may be an elongate aerosol-forming cartridge having a downstream end, through which aerosol exits the aerosol-generating cartridge and is delivered to a user, and an opposed upstream end. In such embodiments, components, or portions of components, of the aerosol-forming substrate may be described as being upstream or downstream of one another based on their relative positions between the proximal or downstream end and the distal or upstream end. Preferably, the cartridge is substantially flat. In certain embodiments, the cartridge is substantially flat and has a rectangular cross-section.

The cartridge may have any suitable size. Preferably, the cartridge has suitable dimensions for use with a handheld aerosol-generating system. In certain embodiments, the cartridge has length of from about 5 mm to about 200 mm, preferably from about 10 mm to about 100 mm, more preferably from about 20 mm to about 35 mm. In certain embodiments, the cartridge has width of from about 5 mm to about 12 mm, preferably from about 7 mm to about 10 mm. In certain embodiments, the cartridge has a height of from about 2 mm to about 10 mm, preferably form about 5 mm to about 8 mm.

Preferably, the at least one aerosol-forming substrate is substantially flat. As used herein, the term "substantially flat" means having a thickness to width ratio of at least 1:2, preferably from 1:2 to about 1:20. This includes, but is not limited to having a substantially planar shape. Flat components can be easily handled during manufacture and provide for a robust construction. In addition, it has been found that aerosol release from the aerosol-forming substrate is improved when it is substantially flat and when a flow of air is drawn across the width, length, or both, of the aerosol-forming substrate.

In certain embodiments, one or both of the base layer and the at least one aerosol-forming substrate has a non-curved cross-section. This reduces the amount of rolling movement of these components during manufacture, improving assembly precision and ease of assembly. In certain embodiments, one or both of the base layer and the at least one aerosol-forming substrate is substantially planar.

The term "base layer" refers to a layer of the cartridge which supports the aerosol-forming substrate and not necessarily to the position of the layer within the cartridge. The base layer may be the lowermost layer of the cartridge, although it is not limited to this position.

The base layer may have any suitable cross-sectional shape. Preferably, the base layer has a non-circular cross-sectional shape. In certain preferred embodiments, the base layer has a substantially rectangular cross-sectional shape. In certain embodiments, the base layer has an elongate, substantially rectangular, parallelepiped shape. In certain preferred embodiments, the base layer is substantially flat.

The aerosol-forming substrate may be arranged directly on the base layer, or indirectly via one or more intermediate layers. The base layer may have a substantially planar top surface on which the aerosol-forming substrate is arranged. In preferred embodiments, the base layer comprises at least one cavity in which the at least one aerosol-forming substrate is held. This helps to maintain correct positioning of the aerosol-forming substrate within the cartridge and makes it easier to seal the aerosol-forming substrate within the cartridge, if required. In certain embodiments, the at least one aerosol-forming substrate comprises a plurality of aerosol-forming substrates arranged separately on the base layer and the base layer comprises a plurality of cavities. Two or more aerosol-forming substrates may then be held in different cavities. Where the aerosol-forming substrates have different compositions, storing them separately in separate cavities can prolong the life of the cartridge. Another advantage is that it also enables the cartridge to store two or more incompatible aerosol-forming substrate substances. In certain embodiments, one or more of the cavities are selectively openable from a closed position.

The base layer may be formed from a single component. Alternatively, the base layer may be formed from multiple layers or components. For example, the base layer may be formed from a first layer defining side walls of the at least one cavity and a second layer defining a bottom wall of the at least one cavity.

The base layer may be formed using any suitable manufacturing method. In certain embodiments, the base layer comprises a polymeric foil. Such a base layer may comprise one or more cavities formed from one or more blisters in the foil. The polymeric foil may comprise any suitable material, such as, but not limited to, one or more of a Polyimide (PI), a Polyaryletherketone (PAEK), such as Polyether Ether Ketone (PEEK), Poly Ether Ketone (PEK), or Polyetherketoneetherketoneketone (PEKEKK), or a Fluoric polymer, such as Polytetrafluoroethylene (PTFE), Polyvinylidene Fluoride (PVDF), Ethylene tetrafluoroethylene (ETFE), PVDFELS, or Fluorinated Ethylene Propylene (FEP). Alternatively, the base layer may be formed by injection moulding of a polymeric material, such as, but not limited to, one or more of a Polyaryletherketone (PAEK), such as Polyether Ether Ketone (PEEK), Poly Ether Ketone (PEK), or Polyetherketoneetherketoneketone (PEKEKK), a Polyphenylensulfide, such as Polypropylene (PP), Polyphenylene sulfide (PPS), or Polychlorotrifluoroethene (PCTFE or PTFCE), a Polyarylsulfone, such as Polysulfone (PSU), Polyphenylsulfone (PPSF or PPSU), Polyethersulfone (PES), or Polyethylenimine (PEI), or a Fluoric polymer, such as Polytetrafluoroethylene (PTFE), Polyvinylidene Fluoride (PVDF), Ethylene tetrafluoroethylene (ETFE), PVDFELS, or Fluorinated Ethylene Propylene (FEP).

The at least one aerosol-forming substrate comprises a tobacco-containing material with volatile tobacco flavour compounds which are released from the aerosol-forming substrate upon heating.

Preferably, the at least one aerosol-forming substrate comprises an aerosol former, that is, a substance which generates an aerosol upon heating. The aerosol former may be, for instance, a polyol aerosol former or a non-polyol aerosol former. It may be a solid or liquid at room temperature, but preferably is a liquid at room temperature. Suitable polyols include sorbitol, glycerol, and glycols like propylene glycol or triethylene glycol. Suitable non-polyols include monohydric alcohols, such as menthol, high boiling point hydrocarbons, acids such as lactic acid, and esters such as diacetin, triacetin, triethyl citrate or isopropyl myristate. Aliphatic carboxylic acid esters such as methyl stearate, dimethyl dodecanedioate and dimethyl tetradecanedioate can also be used as aerosol formers agents. A combination of aerosol formers may be used, in equal or differing proportions. Polyethylene glycol and glycerol may be particularly preferred, whilst triacetin is more difficult to stabilise and may also need to be encapsulated in order to prevent its migration within the product. Examples of suitable aerosol formers are glycerine and propylene glycol. The at least one aerosol-forming substrate may include one or more flavouring agents, such as cocoa, liquorice, organic acids, or menthol. The at least one aerosol-forming substrate may comprise a solid substrate. The solid substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco and expanded tobacco. Optionally, the solid substrate may contain additional tobacco or non-tobacco volatile flavour compounds, to be released upon heating of the substrate. Optionally, the solid substrate may also contain capsules that, for example, include the additional tobacco or non-tobacco volatile flavour compounds. Such capsules may melt during heating of the solid aerosol-forming substrate. Alternatively, or in addition, such capsules may be crushed prior to, during, or after heating of the solid aerosol-forming substrate.

Where the at least one aerosol-forming substrate comprises a solid substrate comprising homogenised tobacco material, the homogenised tobacco material may be formed by agglomerating particulate tobacco. The homogenised tobacco material may be in the form of a sheet. The homogenised tobacco material may have an aerosol-former content of greater than 5 percent on a dry weight basis. The homogenised tobacco material may alternatively have an aerosol former content of between 5 percent and 30 percent by weight on a dry weight basis. Sheets of homogenised tobacco material may be formed by agglomerating particulate tobacco obtained by grinding or otherwise comminuting one or both of tobacco leaf lamina and tobacco leaf stems; alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof. Sheets of homogenised tobacco material are preferably formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

Optionally, the solid substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, such as those disclosed in U.S. Pat. No. 5,505,214, U.S. Pat. No. 5,591,368 and U.S. Pat. No. 5,388,594, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix. The solid substrate may be deposited on the surface of the carrier in the form of, for example, a sheet, foam, gel or slurry. The solid substrate may be deposited on the entire surface of the carrier, or alternatively, may be deposited in a pattern in order to provide a predetermined or non-uniform flavour delivery during use. Alternatively, the carrier may be a non-woven fabric or fibre bundle into which tobacco components have been incorporated, such as that described in EP-A-0 857 431. The non-woven fabric or fibre bundle may comprise, for example, carbon fibres, natural cellulose fibres, or cellulose derivative fibres.

The aerosol-forming substrate may comprise a liquid substrate and the cartridge may comprise means for retaining the liquid substrate, such as one or more containers. Alternatively or in addition, the cartridge may comprise a porous carrier material, into which the liquid substrate is absorbed, as described in WO-A-2007/024130, WO-A-2007/066374, EP-A-1 736 062, WO-A-2007/131449 and WO-A-2007/131450. The aerosol-forming substrate may alternatively be any other sort of substrate, for example, a gas substrate, a gel substrate, or any combination of the various types of substrate described.

The at least one aerosol-forming substrate may comprise a single aerosol-forming substrate. Alternatively, the at least one aerosol-forming substrate may comprise a plurality of aerosol-forming substrates. The plurality of aerosol-forming substrates may have substantially the same composition. Alternatively, the plurality of aerosol-forming substrates may comprise two or more aerosol-forming substrates having substantially different compositions. The plurality of aerosol-forming substrates may be stored together on the base layer. Alternatively, the plurality of aerosol-forming substrates may be stored separately. By separately storing two or more different portions of aerosol-forming substrate, it is possible to store two substances which are not entirely compatible in the same cartridge. Advantageously, separately storing two or more different portions of aerosol-forming substrate may extend the life of the cartridge. It also enables two incompatible substances to be stored in the same cartridge. Further, it enables the aerosol-forming substrates to be aerosolised separately, for example by heating each aerosol-forming substrate separately. Thus, aerosol-forming substrates with different heating profile requirements can be heated differently for improved aerosol formation. It may also enable more efficient energy use, since more volatile substances can be heated separately from less volatile substances and to a lesser degree. Separate aerosol-forming substrates can also be aerosolised in a predefined sequence, for example by heating a different one of the plurality of aerosol-forming substrates for each use, ensuring a 'fresh' aerosol-forming substrate is aerosolised each time the cartridge is used.

Preferably the at least one aerosol-forming substrate is substantially flat. The at least one aerosol-forming substrate may have any suitable cross-sectional shape. Preferably, the at least one aerosol-forming substrate has a non-circular cross-sectional shape. In preferred embodiments, the aerosol-forming substrate has a substantially planar first surface which forms the contact surface between the aerosol-forming substrate and the base layer, and a substantially planar second surface, opposite to the first surface, from which aerosol is releasable upon heating. In certain preferred embodiments, the at least one aerosol-forming substrate has a substantially rectangular cross-sectional shape. In certain embodiments, the at least one aerosol-forming substrate has an elongate, substantially rectangular, parallelepiped shape.

In certain preferred embodiments, the at least one aerosol-forming substrate has a vaporisation temperature of from about 60 degrees Celsius to about 320 degrees Celsius, preferably from about 70 degrees Celsius to about 230 degrees Celsius.

In any of the embodiments of the cartridge, the preferred material or materials for each of the various cartridge components will depend on the required vaporisation temperature of the aerosol-forming substrate.

In use, the at least one aerosol-forming substrate is vaporised by a vaporiser. The vaporiser may be provided as part of an aerosol-generating device, part of the aerosol-forming cartridge, as a separate component, or any combination thereof. The vaporiser may be any suitable device for vaporising the at least one aerosol-forming substrate. For example, the vaporiser may be a piezoelectric device or ultrasonic device. Preferably, the vaporiser comprises an electric heater including at least one heating element configured to heat the aerosol-forming substrate.

Where the aerosol-forming cartridge comprises a vaporiser for vaporising the aerosol-forming substrate, the vaporiser should be arranged on the base layer such that a contact layer between the vaporiser and the base layer is substantially planar and parallel with the contact surface between the base layer and the aerosol-forming substrate. With this arrangement, the cartridge can be manufactured using only vertical assembly operations. This simplifies the manufacture of the cartridge by removing the need for any more complex assembly operations, such as rotational or multi-translational movements of the cartridge or its components. The vaporiser may be substantially flat. In preferred embodiments, the vaporiser is substantially planar.

The vaporiser may be any suitable device for vaporising the aerosol-forming substrate. For example, the vaporiser may be a piezoelectric or ultrasonic device, or a non-electric heater, such as a chemical heater. Preferably, the vaporiser comprises an electric heater including at least one heating element configured to heat the aerosol-forming substrate. In certain preferred embodiments, the cartridge further comprises an electric heater including at least one heating element arranged to heat the at least one aerosol-forming substrate, wherein a contact surface between the electric heater and one or both of the base layer and the at least one aerosol-forming substrate is substantially planar and substantially parallel to the contact surface between the base layer and the at least one aerosol-forming substrate.

The electric heater may be arranged to heat the aerosol-forming substrate by one or more of conduction, convection and radiation. The heater may heat the aerosol-forming substrate by means of conduction and may be at least partially in contact with the aerosol-forming substrate. Alternatively, or in addition, the heat from the heater may be conducted to the aerosol-forming substrate by means of an intermediate heat conductive element. Alternatively, or in addition, the heater may transfer heat to the incoming ambient air that is drawn through or past the cartridge during use, which in turn heats the aerosol-forming substrate by convection.

The heater may be an electric heater powered by an electric power supply. The term "electric heater" refers to one or more electric heating elements. The electric heater may comprise an internal electric heating element for at least partially inserting into the aerosol-forming substrate. An "internal heating element" is one which is suitable for insertion into an aerosol-forming material. Alternatively or additionally, the electric heater may comprise an external heating element. The term "external heating element" refers to one that at least partially surrounds the aerosol-forming substrate. The electric heater may comprise one or more internal heating elements and one or more external heating elements. The electric heater may comprise a single heating element. Alternatively, the electric heater may comprise more than one heating element. In certain embodiments, the cartridge comprises an electric heater comprising one or more heating elements.

The electric heater may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required. Alternatively, the electric heater may comprise an infra-red heating element, a photonic source, or an inductive heating element.

The electric heater may take any suitable form. For example, the electric heater may take the form of a heating blade. Alternatively, the electric heater may take the form of a casing or substrate having different electro-conductive portions, or an electrically resistive metallic tube. Alternatively, the electric heater may comprise one or more heating needles or rods that run through the centre of the aerosol-forming substrate. Alternatively, the electric heater may be a disk (end) heater or a combination of a disk heater with heating needles or rods. The electric heater may comprise one or more stamped portions of electrically resistive material, such as stainless steel. Other alternatives include a heating wire or filament, for example a Ni—Cr (Nickel-Chromium), platinum, tungsten or alloy wire or a heating plate.

In certain preferred embodiments, the electric heater comprises a plurality of electrically conductive filaments. The plurality of electrically conductive filaments may form a mesh or array of filaments or may comprise a woven or non-woven fabric.

The electrically conductive filaments may define interstices between the filaments and the interstices may have a width of between 10 μm and 100 μm. Preferably the filaments give rise to capillary action in the interstices, so that in use, liquid to be vaporised is drawn into the interstices, increasing the contact area between the heater assembly and the liquid. The electrically conductive filaments may form a mesh of size between 160 and 600 Mesh US (+/−10 percent) (i.e. between 160 and 600 filaments per inch (+/−10 percent)). The width of the interstices is preferably between 25 μm and 75 μm. The percentage of open area of the mesh, which is the ratio of the area of the interstices to the total area of the mesh, is preferably between 25 percent and 56 percent. The mesh may be formed using different types of weave or lattice structures. The mesh, array or fabric of electrically conductive filaments may also be characterised by its ability to retain liquid, as is well understood in the art. The electrically conductive filaments may have a diameter of between 10 μm and 100 μm, preferably between 8 μm and 50 μm, and more preferably between 8 μm and 39 μm. The filaments may have a round cross section or may have a flattened cross-section. The heater filaments may be formed by etching a sheet material, such as a foil. This may be particularly advantageous when the heater assembly comprises an array of parallel filaments. If the heater assembly comprises a mesh or fabric of filaments, the filaments may be individually formed and knitted together. The electrically conductive filaments may be provided as a mesh, array or fabric. The area of the mesh, array or fabric of electrically conductive filaments may be small, preferably less than or equal to 25 mm2, allowing it to be incorporated in to a handheld system. The mesh, array or fabric of electrically conductive filaments may, for example, be rectangular and have dimensions of 5 mm by 2 mm. Preferably, the mesh or array of electrically conductive filaments covers an area of between 10 percent and 50 percent of the area of the heater assembly. More preferably, the mesh or array of electrically conductive filaments covers an area of between 15 percent and 25 percent of the area of the heater assembly.

Optionally, the heating element may be deposited in or on a carrier material. In certain preferred embodiments, the heating element is deposited on an electrically insulating substrate foil. The substrate foil may be flexible. The substrate foil may be polymeric. The substrate foil may be a multi-layer polymeric foil. The heating element, or heating elements, may extend across one or more apertures in the substrate foil.

In one embodiment, electric energy is supplied to the electric heater until the heating element or elements of the electric heater reach a temperature of between approximately 180 degrees Celsius and about 310 degrees Celsius. Any suitable temperature sensor and control circuitry may be used in order to control heating of the heating element or elements to reach the required temperature. This is in contrast to conventional cigarettes in which the combustion of tobacco and cigarette wrapper may reach 800 degrees Celsius.

Preferably, the minimum distance between the electric heater and the at least one aerosol-forming substrate is less than 50 micrometers, preferably the cartridge comprises one or more layers of capillary fibres in the space between the electric heater and the aerosol-forming substrate.

The electric heater may comprise one or more heating elements above the at least one aerosol-forming substrate. In preferred embodiments, the electric heater may comprise one or more heating elements positioned between the base layer and the at least one aerosol-forming substrate. With this arrangement, heating of the aerosol-forming substrate and aerosol release occur on opposite sides of the aerosol-forming substrate. This has been found to be particularly effective for aerosol-forming substrates which comprise a tobacco-containing material. In certain embodiments, the heater comprises one or more heating elements positioned adjacent to opposite sides of the aerosol-forming substrate. Preferably the electric heater comprises a plurality of heating elements arranged to heat a different portion of the aerosol-forming substrate. In certain preferred embodiments, the at least one aerosol-forming substrate comprises a plurality of aerosol-forming substrates arranged separately on the base layer and the electric heater comprises a plurality of heating elements each arranged to heat a different one of the plurality of aerosol-forming substrates.

In use, the cartridge may be connected to a separate mouthpiece portion by which a user can draw a flow of air through or adjacent to the cartridge by sucking on a downstream end of the mouthpiece portion. For example, the mouthpiece portion may be provided as part of an aerosol-generating device with which the cartridge is combined to form an aerosol-generating system. In such embodiments, the cartridge may comprise a flange for attaching a detachable mouthpiece portion. In certain preferred embodiments, the cartridge further comprises an integral mouthpiece portion. In such embodiments, preferably, the cartridge is arranged such that the resistance to draw at a downstream end of the mouthpiece portion is from about 50 mmWG to about 130 mmWG, preferably from about 80 mmWG to about 120 mmWG, more preferably from about 90 mmWG to about 110 mmWG, most preferably from about 95 mmWG to about 105 mmWG. As used herein, the term "resistance to draw" refers to the pressure required to force air through the full length of the object under test at the rate of 17.5 ml/sec at 22 degrees Celsius and 101 kPa (760 Torr), is typically expressed in units of millimeters water gauge (mmWG) and is measured in accordance with ISO 6565: 2011.

In any of the embodiments described above, the aerosol-forming cartridge may comprise a data storage device configured to communicate data to an aerosol-generating device when the aerosol-forming cartridge is coupled to the device. The data stored on the aerosol-forming cartridge may include at least one of the type of aerosol-forming cartridge, the manufacturer, the date and time of manufacture, a production batch number, a heating profile, and an indication of whether the aerosol-forming cartridge has been used previously.

In addition to a data storage device, or as an alternative to a data storage device, the aerosol-forming cartridge may comprise an electrical load configured to electrically connect with an aerosol-generating device when the aerosol-forming cartridge is coupled to the device. The electrical load may comprise at least one of a resistive load, a capacitive load and an inductive load. The aerosol-generating device can be configured to control a supply of electrical current to the cartridge based at least in part on the measured electrical load. Thus, the electrical load can be used to identify the type of cartridge.

In a particularly preferred embodiment, the at least one electric load comprises a resistive electric heater. Utilising the heater itself as the resistive load can eliminate the need for a separate and dedicated electrical load that may otherwise be provided specifically for the purpose of distinguishing between different cartridges.

The cartridge may comprise electrical contacts to provide an electrical connection between the cartridge and an aerosol-generating device with which the cartridge may be coupled.

The electrical contacts may be accessible from outside of the cartridge. The electrical contacts may be positioned along one or more edges of the cartridge. In certain embodiments, the electrical contacts may be positioned along a lateral edge of the cartridge. For example, the electrical contacts may be positioned along the upstream edge of the cartridge. Alternatively, or in addition, the electrical contacts may be positioned along a single longitudinal edge of the cartridge.

The electrical contacts may comprise power contacts for supplying power to the cartridge as well as data contacts for transferring data to or from the cartridge, or both to and from the cartridge.

The electrical contacts may have any suitable form. The electrical contacts may be substantially flat. Advantageously, substantially flat electrical contacts have been found to be more reliable for establishing an electrical connection and are easier to manufacture. Preferably, the electrical contacts comprise part of a standardised electrical connection, including, but not limited to, USB-A, USB-B, USB-mini, USB-micro, SD, miniSD, or microSD type connections. Preferably, the electrical contacts comprise the male part of a standardised electrical connection, including, but not limited to, USB-A, USB-B, USB-mini, USB-micro, SD, miniSD, or microSD type connections. As used herein, the term "standardised electrical connection" refers an electrical connection which is specified by an industrial standard.

The electrical contacts may be formed integrally with the electric circuitry. In certain preferred embodiments, the cartridge comprises an electric heater to which the electrical contacts are connected. In such embodiments, the electric heater may comprise an electrically insulating substrate foil on or in which the electrical contacts and one or more heating elements are disposed.

In certain embodiments, the cartridge may comprise a cover layer fixed to the base layer and over at least part of the at least one aerosol-forming substrate. Advantageously, the cover layer may hold the at least one aerosol-forming substrate in place on the base layer. The cover layer may be fixed to the base layer by virtue of being formed integrally with the base layer. Alternatively, the cover layer may be a separate component fixed directly to the base layer, or indirectly via one or more intermediate layers or components. Aerosol released by the aerosol-forming substrate may pass through one or more apertures in the cover layer, base layer, or both. The cover layer may have at least one gas permeable window to allow aerosol released by the aerosol-forming substrate to pass through the cover layer. The gas permeable window may be substantially open. Alternatively, the gas permeable window may comprise a perforated membrane, or a grid extending across an aperture in the cover layer. The grid may be of any suitable form, such as a transverse grid, longitudinal grid, or mesh grid. The cover layer may form a seal with the base layer. The cover layer may form a hermetic seal with the base layer. The cover layer may comprise a polymeric coating at least where the cover layer is fixed to the base layer, the polymeric coating forming a seal between the cover layer and the base layer.

The aerosol-forming cartridge may comprise a protective foil positioned over at least part of the at least one aerosol-forming substrate. The protective foil may be gas impermeable. The protective foil may be arranged to hermetically seal the aerosol-forming substrate within the cartridge. As used herein, the term "hermetically seal" means that the weight of the volatile compounds in the aerosol-forming substrate changes by less than 2 percent over a two week period, preferably over a two month period, more preferably over a two year period. Where the base layer comprises at least one cavity in which the aerosol-forming substrate is held, the protective foil may be arranged to close the one or more cavities. The protective foil may be at least partially removable to expose the at least one aerosol-forming substrate. Preferably, the protective foil is removable. Where the base layer comprises a plurality of cavities in which a plurality of aerosol-forming substrates are held, the protective foil may be removable in stages to selectively unseal one or more of the aerosol-forming substrate. For example, the protective foil may comprise one or more removable sections, each of which is arranged to reveal one or more of the cavities when removed from the remainder of the protective foil. Alternatively, or in addition, the protective foil may be attached such that the required removal force varies between the various stages of removal as an indication to the user. For example, the required removal force may increase between adjacent stages so that the user must deliberately pull harder on the protective foil to continue removing the protective foil. This may be achieved by any suitable means. For example, the required removal force may be varied by altering the type, quantity, or shape of an adhesive layer, or by altering the shape or amount of a weld line by which the protective foil is attached.

The protective foil may be removably attached to the base layer either directly or indirectly via one or more intermediate components. Where the cartridge comprises a cover layer as described above, the protective foil may be removably attached to the cover layer. Where the cover layer has one or more gas permeable windows, the protective foil may extend across and close the one or more gas permeable windows. The protective foil may be removably attached by any suitable method, for example using adhesive. The protective foil may be removably attached by ultrasonic welding. The protective foil may be removably attached by ultrasonic welding along a weld line. The weld line may be continuous. The weld line may comprise two or more continuous weld lines arranged side by side. With this arrangement, the seal can be maintained provided at least one of the continuous weld lines remains intact.

The protective foil may be a flexible film. The protective foil may comprise any suitable material or materials. For example, the protective foil may comprise a polymeric foil. The polymeric foil may comprise any suitable material, such as, but not limited to, one or more of a Polyimide (PI), a Polyaryletherketone (PAEK), such as Polyether Ether Ketone (PEEK), Poly Ether Ketone (PEK), or Polyetherketoneetherketoneketone (PEKEKK), or a Fluoric polymer, such as Polytetrafluoroethylene (PTFE), Polyvinylidene Fluoride (PVDF), Ethylene tetrafluoroethylene (ETFE), PVDFELS, or Fluorinated Ethylene Propylene (FEP). The protective foil may comprise a multilayer polymeric foil.

The aerosol-forming cartridge may comprise an air inlet and an air outlet connected by an air flow channel in fluid communication with the aerosol-forming substrate when the cartridge is in use. The air flow channel may have an internal wall surface on which one or more flow disturbing devices are disposed, the flow disturbing devices being arranged to create a turbulent boundary layer in a flow of air drawn through the air flow channel. In some embodiments, the flow disturbing devices comprise one or more dimples or undulations on the internal wall surface.

According to a second aspect of the present invention, there is provided an electrically operated aerosol-forming system comprising an aerosol-generating device, an aerosol-forming cartridge as described in any of the embodiments above, and an electric vaporiser for vaporising the at least one aerosol-forming substrate, the device comprising: a main body defining a slot-shaped receptacle for removably receiving the aerosol-forming cartridge; and an electric power supply for supplying power to the vaporiser.

According to a third aspect of the present invention, there is provided a method of manufacturing an aerosol-forming cartridge for use in an electrically operated aerosol-generating system, the method comprising the steps of: providing a base layer on an assembly line; and placing at least one aerosol-forming substrate on the base layer such that the base layer and the at least one aerosol-forming substrate are in contact at a contact surface which is substantially planar, wherein the aerosol-forming substrate comprises a tobacco-containing material with volatile tobacco flavour compounds which are released from the aerosol-forming substrate upon heating.

The base layer may be formed from a single component. Alternatively, the base layer may comprise multiple layers or components which combine to form the base layer. The base layer may have a substantially planar top surface and the step of placing at least one aerosol-forming substrate on the base layer may be carried out by placing the aerosol-forming substrate on the substantially planar top surface.

In certain preferred embodiments, the method further comprises the step of forming at least one cavity in the base layer, wherein the step of placing at least one aerosol-forming substrate on the base layer is carried out by placing the at least one aerosol-forming substrate in the at least one cavity. The cavity may be pre-formed in the base layer. In certain embodiments, the base layer comprises one or more moulded components and the cavity is formed by the mould in which the one or more moulded components are made. In such embodiments, the base layer may be injection-moulded. Alternatively, the cavity may be formed in an existing base layer component by thermoforming or cold forming. The cavity may be formed in an existing base layer component using mechanical action, or under an applied pressure, vacuum, or any combination thereof. In certain embodiments, the step of providing a base layer comprises feeding a web of base layer foil to the assembly line and the step of forming at least one cavity in the base layer is carried out by thermoforming or cold forming a blister in the web of base layer foil.

The method may further comprise the step of providing a vaporiser for vaporising the at least one aerosol-forming substrate when the cartridge is in use. For example, the vaporiser may comprise an electric heater which is attached to the base layer. In certain embodiments, the method comprises the step of attaching an electric heater to the base layer such that the electric heater and the base layer are in contact at a contact surface which is substantially planar and is substantially parallel to the contact surface between the base layer and the at least one aerosol-forming substrate. The electric heater may be attached directly to the base layer or indirectly via one or more intermediate components. The electric heater may be attached by any suitable method, for example by lamination, welding, gluing, or by mechanical fixation, such as being held in place by another component of the cartridge.

The electric heater may be pre-formed and placed in the cartridge as an individual component. In certain embodiments the step of attaching an electric heater is carried out by feeding a web of electric heater foil from a bobbin to the assembly line and cutting the web of electric heater foil transversely to form individual electric heaters. As used herein, the term "transversely" refers to a direction substantially perpendicular to the direction of a stream of components on the assembly line. The electric heater foil may comprise one or more electrically conductive layers, such as aluminium foil, from which the heater may be formed, for example by cutting one or more heating elements into the foil. In certain embodiments, the web of electric heater foil comprises a web of electrically insulating substrate foil to which a plurality of heating elements is attached. The electrically insulating substrate foil may comprise one or more electrically insulating layers of polymeric foil. The polymeric foil may comprise any suitable material, such as, but not limited to, one or more of a Polyimide (PI), a Polyaryletherketone (PAEK), such as Polyether Ether Ketone (PEEK), Poly Ether Ketone (PEK), or Polyetherketoneetherketoneketone (PEKEKK), or a Fluoric polymer, such as Polytetrafluoroethylene (PTFE), Polyvinylidene Fluoride (PVDF), Ethylene tetrafluoroethylene (ETFE), PVDFELS, or Fluorinated Ethylene Propylene (FEP). In one particular embodiment, the electric heater foil comprises a stainless steel heating element sandwiched between two layers of polymer foil.

The base layer may be formed by any suitable method. In certain embodiments, each base layer is formed from an injection-moulded polymeric material, such as, but not limited to, one or more of a Polyaryletherketone (PAEK), such as Polyether Ether Ketone (PEEK), Poly Ether Ketone (PEK), or Polyetherketoneetherketoneketone (PEKEKK), a Polyphenylensulfide, such as Polypropylene (PP), Polyphenylene sulfide (PPS), or Polychlorotrifluoroethene (PCTFE or PTFCE), a Polyarylsulfone, such as Polysulfone (PSU), Polyphenylsulfone (PPSF or PPSU), Polyethersulfone (PES), or Polyethylenimine (PEI), or a Fluoric polymer, such as Polytetrafluoroethylene (PTFE), Polyvinylidene Fluoride (PVDF), Ethylene tetrafluoroethylene (ETFE), PVDFELS, or Fluorinated Ethylene Propylene (FEP Alternatively, the step of providing a base layer comprises feeding a web of base layer foil from a bobbin to the assembly line and cutting the web of base layer foil transversely to form individual base layers. Alternatively, or in addition, the step of providing a base layer may comprise providing a web of substrate foil and a web of intermediate foil, attaching the webs of substrate foil and intermediate foil together to form a web of base layer foil and cutting the web of base layer foil transversely to form individual base layers. The web of substrate foil may comprise part of a web of electric heater foil. In such embodiments, the method may comprise the step of attaching an electric heater to the base layer, wherein the web of substrate foil is formed by a web of electrically insulating substrate foil to which a plurality of heating elements is attached. The web of base layer foil may comprise any suitable material or materials. For example, the web of base layer foil may comprise one or more layers of a polymeric foil. The polymeric foil may comprise any suitable material, such as, but not limited to, one or more of a Polyimide (PI), a Polyaryletherketone (PAEK), such as Polyether Ether Ketone (PEEK), Poly Ether Ketone (PEK), or Polyetherketoneetherketoneketone (PEKEKK), or a Fluoric polymer, such as Polytetrafluoroethylene (PTFE), Polyvinylidene Fluoride (PVDF), Ethylene tetrafluoroethylene (ETFE), PVDFELS, or Fluorinated Ethylene Propylene (FEP).

The method may further comprise the step of providing a cover layer over the at least one aerosol-forming substrate and attaching the cover layer to the base layer. Advantageously, the cover layer is arranged to hold the at least one aerosol-forming substrate in place on the base layer. In certain embodiments, the cover layer is formed from an injection-moulded polymer. In such embodiments, the cover layer may comprise any suitable material or materials. For example, an injection moulded cover layer may be formed from an injection-moulded polymeric material, such as, but not limited to, one or more of a Polyaryletherketone (PAEK), such as Polyether Ether Ketone (PEEK), Poly Ether Ketone (PEK), or Polyetherketoneetherketoneketone (PEKEKK), a Polyphenylensulfide, such as Polypropylene (PP), Polyphenylene sulfide (PPS), or Polychlorotrifluoroethene (PCTFE or PTFCE), a Polyarylsulfone, such as Polysulfone (PSU), Polyphenylsulfone (PPSF or PPSU), Polyethersulfone (PES), or Polyethylenimine (PEI), or a Fluoric polymer, such as Polytetrafluoroethylene (PTFE), Polyvinylidene Fluoride (PVDF), Ethylene tetrafluoroethylene (ETFE), PVDFELS, or Fluorinated Ethylene Propylene (FEP).

Alternatively, the step of providing a cover layer may comprise unwinding a web of cover layer foil from a bobbin and attaching the cover layer foil to the base layer foil. The cover layer foil may be attached to the base layer foil by any suitable method, for example by welding. The web of cover layer foil may comprise any suitable material or materials. For example, the web of cover layer foil may comprise one or more layers of a polymeric foil. The polymeric foil may comprise any suitable material, such as, but not limited to, one or more of a Polyimide (PI), a Polyaryletherketone (PAEK), such as Polyether Ether Ketone (PEEK), Poly Ether Ketone (PEK), or Polyetherketoneetherketoneketone (PEKEKK), or a Fluoric polymer, such as Polytetrafluoroethylene (PTFE), Polyvinylidene Fluoride (PVDF), Ethylene tetrafluoroethylene (ETFE), PVDFELS, or Fluorinated Ethylene Propylene (FEP).

The method may further comprise the step of providing a protective foil over the at least one aerosol-forming substrate to restrict the release of volatile compounds from the aerosol-forming substrate. The protective foil may be arranged to hermetically seal the aerosol-forming substrate within the cartridge. The step of providing a protective foil may comprise unwinding a web of protective foil from a bobbin and attaching the protective foil to the base layer foil, either directly, or indirectly via one or more intermediate layers.

The protective foil may be attached to the base layer foil by any suitable method, for example by welding. The protective foil may comprise any suitable material or materials. For example, the protective foil may comprise one or more layers of polymeric foil. The polymeric foil may comprise any suitable material, such as, but not limited to, one or more of a Polyimide (PI), a Polyaryletherketone (PAEK), such as Polyether Ether Ketone (PEEK), Poly Ether Ketone (PEK), or Polyetherketoneetherketoneketone (PEKEKK), or a Fluoric polymer, such as Polytetrafluoroethylene (PTFE), Polyvinylidene Fluoride (PVDF), Ethylene tetrafluoroethylene (ETFE), PVDFELS, or Fluorinated Ethylene Propylene (FEP).

The method may further comprise the step of providing a top cover attached to the base layer and over the aerosol-forming substrate. The top cover may comprise an air inlet and an air outlet connected by an air flow channel. The top cover may be formed from a single component. Alternatively, the top cover may comprise multiple layers or components which combine to form the top cover. The top cover may have a substantially planar top surface. In certain preferred embodiments, the method further comprises the step of forming at least one cavity in the top cover to at least partially define the air flow channel. The cavity may be pre-formed in the top cover. In certain embodiments, the top cover comprises one or more moulded components and the cavity is formed by the mould in which the one or more moulded components are made. In such embodiments, the top cover may be injection-moulded. Alternatively, the cavity may be formed in an existing top cover component by thermoforming or cold forming. The cavity may be formed in an existing top cover component using mechanical action, or under an applied pressure, vacuum, or any combination thereof. In certain embodiments, the step of providing a top cover comprises feeding a web of top cover foil to the assembly line and the step of forming at least one cavity in the top cover is carried out by thermoforming or cold forming a blister in the web of top cover foil.

Where one or more of the components of the cartridge are formed from one or more webs of foil, the one or more webs of foil may be single width. In other words, each web may have substantially the same width as the respective component of the cartridge that the web is used to form. In certain preferred embodiments, the one or more webs of foil may each have a width that is from about two times to about 50 times greater than the width of the respective component that the web is used to form. Advantageously, this allows a plurality of aerosol-forming cartridges to be made in parallel.

Where one or more of the components of the cartridge are formed from two or more webs of foil, the two webs of foil may be attached together by any suitable method, for example using adhesive, by welding, by fusing, or any combination thereof. In one particular embodiment, two or more layers of the cartridge are laminated together. In such an example, two layers are pressed together and one or both are partially melted, for example using heat, ultrasound, or both, to fuse the layers together.

The method may comprise conveying the cartridge components on a conveyor. The conveyor may be a continuous conveyor, such as a conveyor belt. The conveyor may have a plurality of cavities for receiving one or more components of the cartridge during manufacture to ensure correct placement of those components on the conveyor. The cavities may be arranged in two or more parallel rows. The cavities may be arranged in a grid. Advantageously, this allows a plurality of aerosol-forming cartridges to be made in parallel. Alternatively, the conveyor may comprise one or more webs of foil from which the cartridges are made and which are pulled along the assembly line by a drive wheel or other driving means. For example, the conveyor may comprise the web of base layer foil.

According to a fourth aspect of the invention, there is provided a method of manufacturing an aerosol-forming cartridge according to any of the embodiments described above.

Although the disclosure has been described by reference to different aspects, it should be clear that features described in relation to one aspect of the disclosure may be applied to the other aspects of the disclosure.

The invention will now be further described, by way of example only, with reference to the accompanying drawings in which:

FIG. 2A is a perspective view and FIG. 2B is an exploded view of the cartridge;

FIG. 3A is a perspective view and FIG. 3B is an exploded view of the cartridge;

FIG. 4A is a perspective view and FIG. 4B is an exploded view of the cartridge;

Figure 1A:
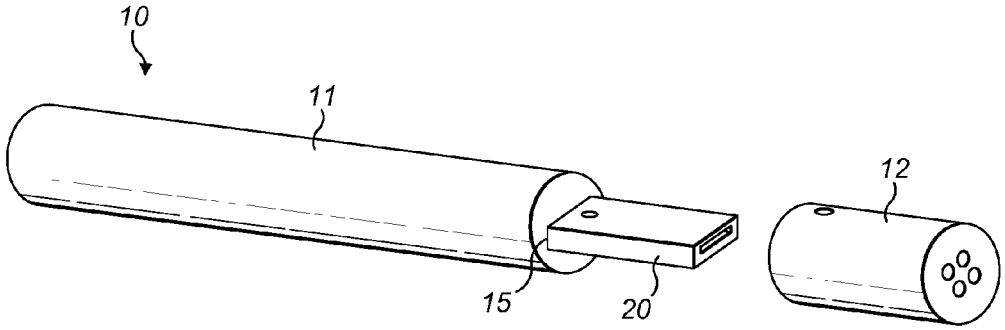
FIGS. 1A, 1B and 1C show a schematic illustration of an aerosol-generating system comprising an aerosol-forming cartridge in accordance with the present invention inserted into an electrically operated aerosol-generating device.
Figure 1B:
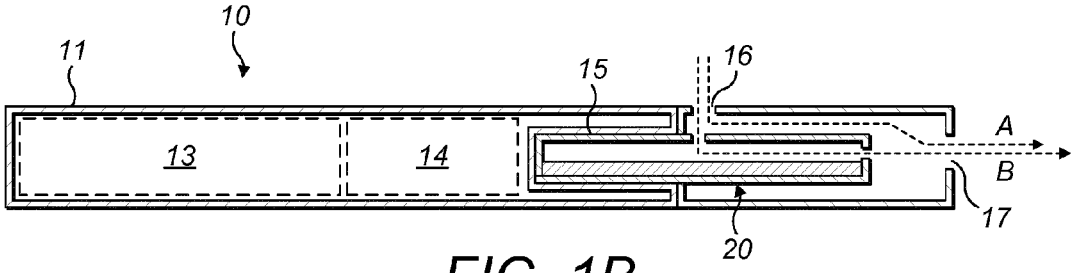

FIGS. 1A and 1B show an aerosol-generating device 10 and a separate, removable aerosol-forming cartridge 20, which together form an aerosol-generating system. The device 10 is portable and has a size comparable to a conventional cigar or cigarette. The device 10 comprises a main body 11 and a removable mouthpiece portion 12. The main body 12 contains a battery 13, such as a lithium iron phosphate battery, electric circuitry 14 and a slot-shaped cavity 15. The mouthpiece portion 12 fits over the cartridge and is connected to the main body 11 by a releasable connecting means (not shown). The mouthpiece portion 12 can be removed (as shown in FIG. 1) to allow for insertion and removal of cartridges and is connected to the main body 11 when the system is to be used to generate aerosol, as will be described. The mouthpiece portion 12 comprises an air inlet 16 and an air outlet 17, each of which may comprise one or more orifices. In use, a user sucks or puffs on the air outlet 17 to draw air from the air inlet 16, through the mouthpiece portion 12 to the air outlet 17. A flow of air drawn through the mouthpiece portion 12 may be drawn past the cartridge 20 (as shown by the arrows marked as "A" in FIG. 2), or also through one or more air flow channels in the cartridge 20 (as indicated by the arrows marked as "B" in FIG. 2). The cavity 15 has a rectangular cross-section and is sized to receive at least part of the cartridge 20 to removably connect the device 10 and the cartridge 20. As used herein, the term "removably connect" means that the device and the cartridge can be coupled and uncoupled from one another without significant damage to either.

Figure 1C:
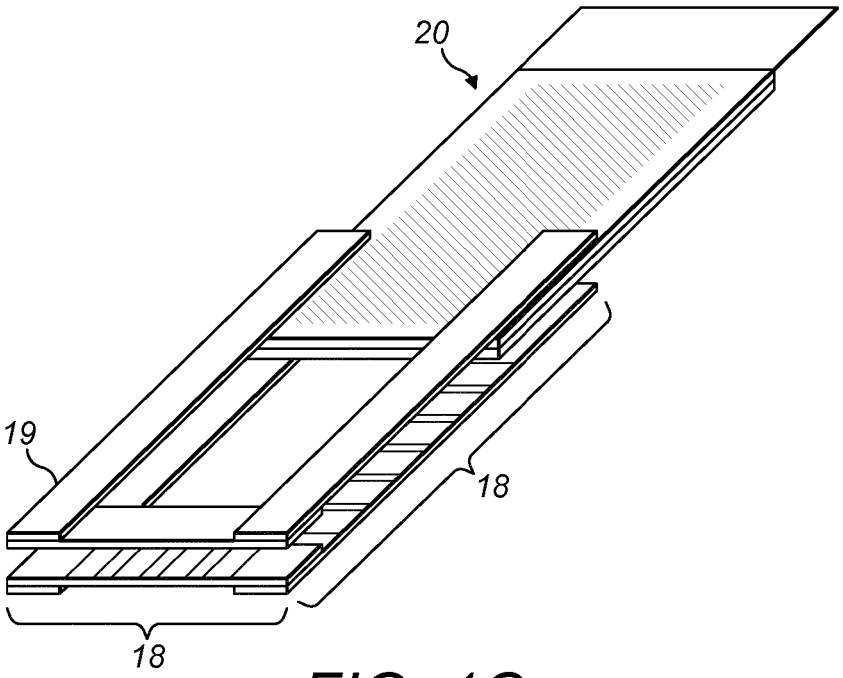

FIG. 1C shows a schematic illustration of a connection between the device 10 and the cartridge 20 within the cavity 15, with the cartridge 20 shown as partially inserted and the arrow indicating the direction of insertion. Electrical contacts 18 are provided along a side portion and a bottom portion of the cavity 15 to provide an electrical connection between the electric circuitry 14 and the battery 13 with corresponding electrical contacts on the cartridge 20. Guide rails 19 are provided in the cavity 15 to assist with the correct positioning of the cartridge 20 within the cavity 15.

Figure 2A:
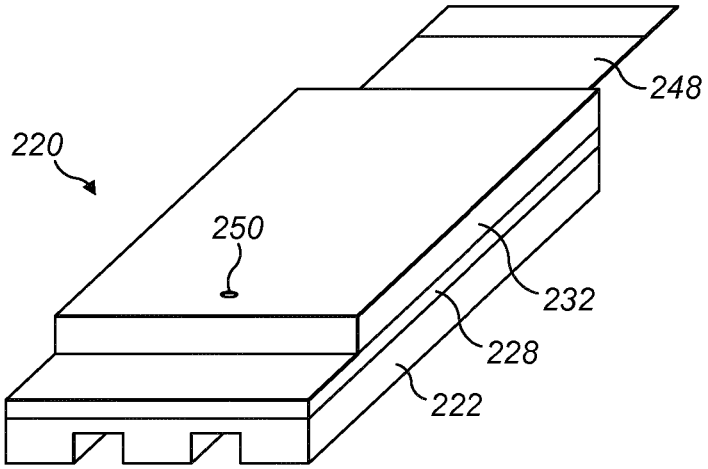
FIGS. 2A and 2B show a first embodiment of an aerosol-forming cartridge in accordance with the present invention, where
Figure 2B:
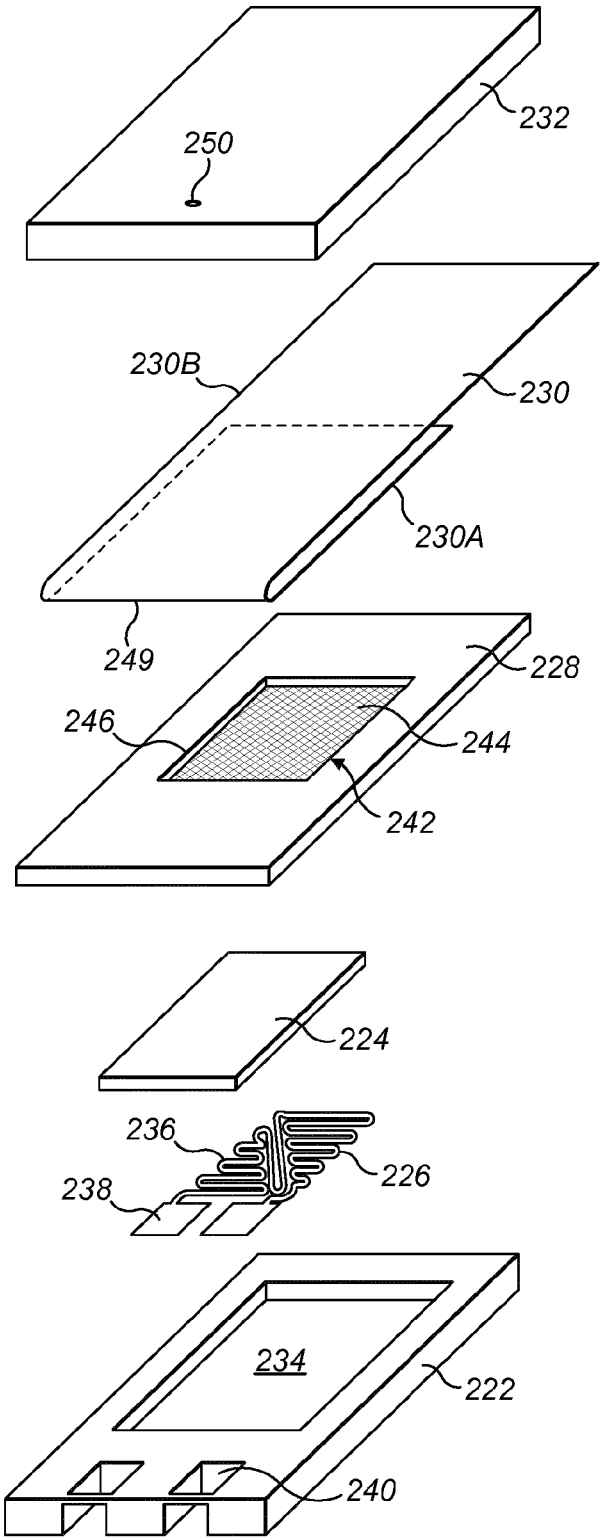

FIGS. 2A and 2B show a first embodiment of aerosol-forming cartridge 220. The cartridge 220 is substantially flat and has a rectangular cross-section, although it could have any other suitable flat shape. The cartridge comprises a base layer 222, an aerosol-forming substrate 224 arranged on the base layer 222, a heater 226 positioned between the aerosol-forming substrate 224 and the base layer 222, a cover layer 228 fixed to the base layer 222 and over the aerosol-forming substrate 224, a protective foil 230 over the cover layer 228 and a top cover 232 fixed to the cover layer 228 and over the cover layer 228 and the protective foil 230. The base layer 222, aerosol-forming substrate 224, heater 226, cover layer 228, protective foil 230 and top cover 232 are all substantially flat and substantially parallel to each other. The contact surfaces between each of these components of the cartridge 220 are substantially planar and substantially parallel with each other.

The base layer 222 has a cavity 234 defined on its top surface in which the heater 226 and the aerosol-forming substrate 224 are held. The aerosol-forming substrate 224 comprises a tobacco-containing material with volatile flavour compounds which are releasable from the aerosol-forming substrate 224 upon heating by the heater 226. In this example, the aerosol-forming substrate 224 is a substantially flat rectangular block of tobacco cast leaf.

The heater 226 comprises a heating element 236 connected to electrical contacts 238. In this example, the heating element 236 and electrical contacts 238 are integral and the heater 226 is formed by stamping a sheet of stainless steel. The base layer 222 has two contact apertures 240 at its distal end into which the electrical contacts 238 extend. The electric contacts 238 are accessible from outside of the cartridge through the contact apertures 240.

The cover layer 228 helps to keep the aerosol-forming substrate 224 in position on the base layer 222. The cover layer 228 has a permeable window 242 formed by a mesh grid 244 extending across an opening 246 in the cover layer 228. In use, aerosol released by the aerosol-forming substrate 224 passes through the permeable window 242. The cover layer 228 is sized to fit over the cavity 234 in the base layer 222. In this example, the cover layer 228 extends laterally beyond the cavity 234 and has substantially the same width and length as the base layer 222 so the edges of the cover layer 228 and the base layer 222 are generally aligned.

The protective foil 230 is removably attached to the top of the cover layer 228 and over the permeable window 242 to seal the aerosol-forming substrate 224 within the cartridge 220. The protective foil 230 comprises a substantially impermeable sheet that is welded to the cover layer 228 but which can be easily peeled off. The sheet is welded to the cover layer 228 along a continuous sealing line formed of two continuous weld lines arranged side by side. The protective foil 230 acts to prevent substantial loss of volatile compounds from the aerosol-forming substrate 224 prior to use of the cartridge 220. In this example, the protective foil 230 is formed from a flexible multilayer polymer sheet. A tab 248 is provided at the free end of the protective foil 230 to allow a user to grasp the protective foil 230 to peel it off from over the permeable window 242.

The tab 248 is formed by an extension of the protective foil 230 and extends beyond the edge of the top cover 232. To facilitate removal, the protective foil 230 is folded over itself at a transverse fold line 249 such that the protective foil 230 is divided into a first portion 230A, which is attached to the cover layer 228 by the continuous sealing line, and a second portion 230B, which extends longitudinally from the fold line 249 to the tab 248. The section portion 230B lies flat against the first portion 230A so that the first and second portions 230A, 230B are substantially co-planar. With this arrangement, the protective foil 230 can be removed by pulling the tab 248 longitudinally to peel the first portion 230A away from the cover layer 228 at the fold line 249.

It will be apparent to one of ordinary skill in the art that, although welding is described as the method to secure the removable protective foil 230 to the cover layer 228, other methods familiar to those in the art may also be used including, but not limited to, heat sealing or adhesive, provided the protective foil 230 may easily be removed by a consumer.

The top cover 232 is hollow and includes an air inlet 250 towards its distal end and an air outlet (not shown) at its proximal end. The air inlet 250 and the air outlet are connected by an air flow channel (not shown) which is defined between an internal wall surface (not shown) of the top cover 232 and the cover layer 228 below.

During use, the protective foil 230 is removed by pulling the tab 248 in a longitudinal direction and away from the cartridge 220. Once the protective foil 230 has been removed, the aerosol-forming substrate 224 is in fluid communication with the air flow channel via the permeable window 242 in the cover layer 228. The cartridge 220 is then inserted into an aerosol-generating device, as shown in FIGS. 1A and 1B, so that the electrical contacts 238 connect with the corresponding electrical contacts in the cavity of the device. Electrical power is then provided by the device to the heater 226 of the cartridge to release aerosol from the aerosol-forming substrate. When a user sucks or puffs on the mouthpiece portion of the device, air is drawn from the air inlets in the mouthpiece, into the air inlet 250 of the top cover and through the air flow channel in the top cover, where it is mixed with the aerosol. The air and aerosol mixture is then drawn through the air outlet of the cartridge 220 to the outlet of the mouthpiece portion.

Once the aerosol-forming substrate 224 has been consumed by a user, the cartridge is removed from the cavity of the device and replaced.

Figure 3A:
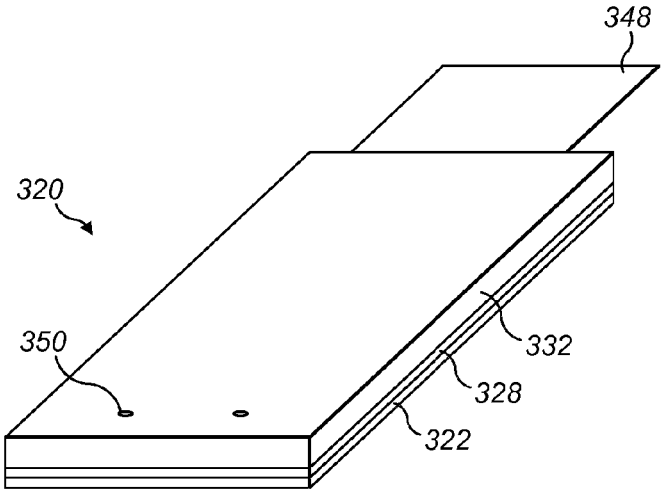
FIGS. 3A and 3B show a second embodiment of an aerosol-forming cartridge in accordance with the present invention, where
Figure 3B:
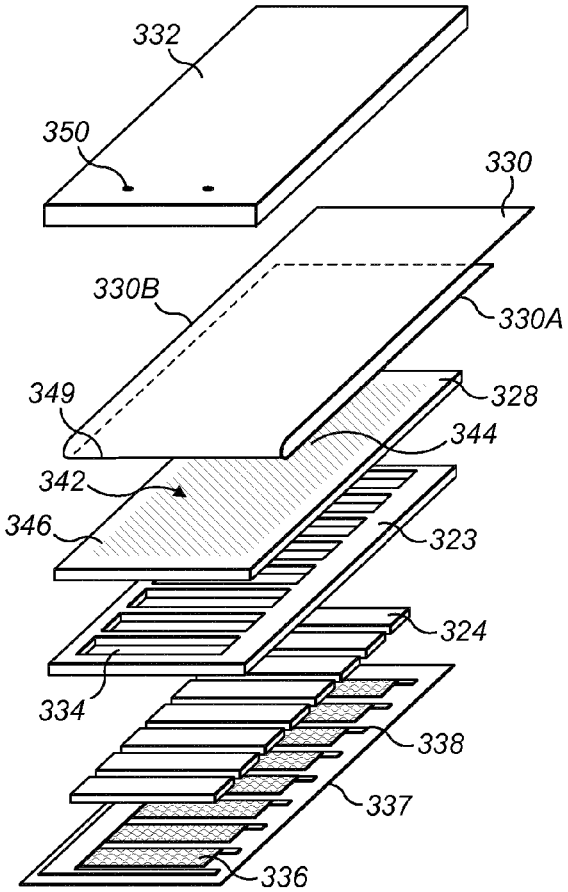

FIGS. 3A and 3B show a second embodiment of aerosol-forming cartridge 320. In this example, the cartridge 320 is substantially flat and has a rectangular cross-section, although it could be any other suitable flat shape. The cartridge comprises a base layer 322 formed from an intermediate layer 323 and a heater 326 placed beneath and fixed to the intermediate layer 323. The cartridge also comprises a plurality of aerosol-forming substrates 324 arranged on the base layer 322, a cover layer 328 fixed to the base layer 322 and over the aerosol-forming substrates 324, a protective foil 330 over the cover layer 328 and a top cover 332 fixed to the cover layer 328 and over the cover layer 328 and the protective foil 330. The intermediate layer 323, aerosol-forming substrates 324, heater 326, cover layer 328, protective foil 330 and top cover 332 are all substantially flat and substantially parallel to each other. The contact surfaces between any two of these components 320 are substantially planar and substantially parallel.

The intermediate layer 323 has a plurality of cavities 334 extending through its thickness, the bottoms of which are closed by the heater 326. The aerosol-forming substrates 324 are held in the plurality of cavities. In this example, the cavities 334 are substantially rectangular and arranged with their long sides substantially perpendicular to the longitudinal axis of the cartridge 320. The aerosol-forming substrates 324 each comprise a tobacco-containing material with volatile flavour compounds which are releasable upon heating by the heater 326. In this example, each aerosol-forming substrate is a substantially flat rectangular block of tobacco cast leaf.

The heater 326 comprises a plurality of heating elements 336 connected to electrical contacts 338. In this example, the heater 326 is formed by disposing electrical contacts 338 and substantially rectangular heating elements 336 on an electrically insulating substrate foil 337 such that each of the heating elements 336 lies beneath an aerosol-forming substrate 324. The electrically insulating substrate foil 337 is sized to extend across the width and length of each cavity 334 to close off the bottom of the cavities 334. The electric contacts 338 extend along a side edge of the electrically insulating substrate foil 337 and are accessible from outside of the cartridge from underneath, since the heater 326 is the bottom layer of the cartridge 320. In this example, an electric contact 338 is provided for each of the plurality of heating elements 336. Thus, each heating element 336 can be powered separately, enabling each aerosol-forming substrate 324 to be heated separately. This enables sequential heating of the aerosol-forming substrates, for example to heat a 'fresh', or previously unheated, aerosol-forming substrate 324 for each predetermined aerosol delivery operation. In other embodiments, the heater may be external. That is, the heater is not provided in the cartridge but is adjacent to the cartridge when inserted in an aerosol-generating device. In such examples, a heat conductive substrate foil, such as aluminium foil, may be used in place of the heater.

The cover layer 328 helps to keep the aerosol-forming substrates 324 in position in the cavities 334 of the base layer 322. The cover layer 328 has a permeable window 342 formed by a grid 344 extending across an opening 346 in the cover layer 328. In use, aerosol released by the aerosol-forming substrate 324 passes through the permeable window 342. The cover layer 328 is sized to fit over the cavities 334 in the base layer 322. In this example, the cover layer 328 extends laterally beyond the cavities 334 and has substantially the same width and length as the base layer 322 so the edges of the cover layer 328 and the base layer 322 are generally aligned.

The protective foil 330 is removably attached to the top of the cover layer 328 and over the permeable window 342 to seal the aerosol-forming substrates 324 within the cavities 334. The protective foil 330 comprises a substantially impermeable sheet that is welded to the cover layer 328 but which can be easily peeled off. The sheet is welded to the cover layer 328 along a continuous sealing line formed of two continuous weld lines arranged side by side. The protective foil 330 acts to prevent substantial loss of volatile compounds from the aerosol-forming substrate 324 prior to use of the cartridge 320. In this example, the protective foil 330 is formed from a flexible multilayer polymer sheet. A tab 348 is provided at the free end of the protective foil 330 to allow a user to grasp the protective foil 330 to peel it off from over the permeable window 342. The tab 348 is formed by an extension of the protective foil 330 and extends beyond the edge of the top cover 332. To facilitate removal, the protective foil 330 is folded over itself at a transverse fold line 349 such that the protective foil 330 is divided into a first portion 330A, which is attached to the cover layer 328 by the continuous sealing line, and a second portion 330B, which extends longitudinally from the fold line 349 to the tab 348. The section portion 330B lies flat against the first portion 330A so that the first and second portions 330A, 330B are substantially co-planar. With this arrangement, the protective foil 330 can be removed by pulling the tab 348 longitudinally to peel the first portion 330A away from the cover layer 328 at the fold line 349. It will be apparent to one of ordinary skill in the art that, although welding is described as the method to secure the removable protective foil 330 to the cover layer 328, other methods familiar to those in the art may also be used including, but not limited to, heat sealing or adhesive, provided the protective foil 330 may easily be removed by a consumer.

The top cover 332 is hollow and includes a plurality of air inlets 350 towards its distal end and an air outlet (not shown) at its proximal end. The air inlets 350 and the air outlet are connected by an air flow channel (not shown) which is defined between an internal wall surface (not shown) of the top cover 332 and the cover layer 328 below.

During use, the protective foil 330 is removed by pulling the tab 348 in a longitudinal direction that and away from the cartridge 320. Once the protective foil 330 has been removed, the aerosol-forming substrates 324 are in fluid communication with the air flow channel via the permeable window 342 in the cover layer 328. The cartridge 320 is then inserted into an aerosol-generating device, as shown in FIGS. 1A and 1B, so that the electrical contacts 338 connect with the corresponding electrical contacts in the cavity of the device. Electrical power is then provided by the device to the heater 326 of the cartridge to release aerosol from one or more of the aerosol-forming substrates. When a user sucks or puffs on the mouthpiece portion of the device, air is drawn from the air inlets in the mouthpiece, into the air inlet 350 of the top cover and through the air flow channel in the top cover, where it is mixed with the aerosol. The air and aerosol mixture is then drawn through the air outlet of the cartridge 320 to the outlet of the mouthpiece portion.

Once the aerosol-forming substrate 324 has been consumed by a user, the cartridge is removed from the cavity of the device and replaced.

Figure 4A:
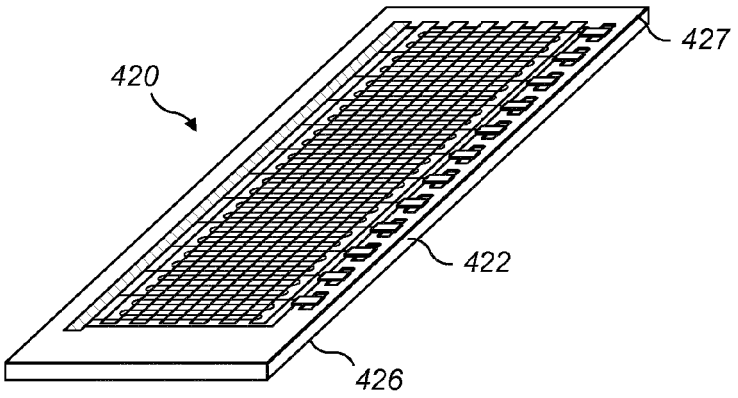
FIGS. 4A and 4B show a third embodiment of an aerosol-forming cartridge in accordance with the present invention, where
Figure 4B:
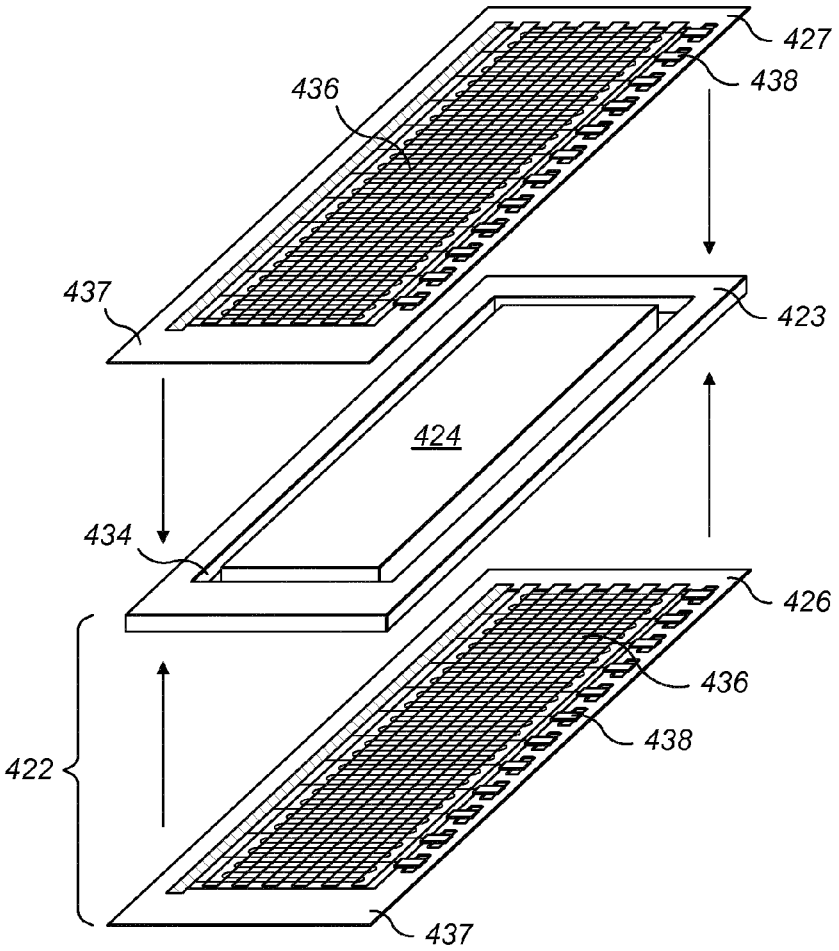

FIGS. 4A and 4B show a third embodiment of aerosol-forming cartridge 420. In this example, the cartridge 420 is substantially flat and has a rectangular cross-section, although it could be any other suitable flat shape. The cartridge comprises a base layer 422 formed from an intermediate layer 423 and a first heater 426 placed beneath and fixed to the intermediate layer 423. The cartridge also comprises an aerosol-forming substrate 424 arranged in the base layer 422 and a second heater 427 positioned over the aerosol-forming substrate 424 and fixed to the top of the base layer 422. The intermediate layer 422, the aerosol-forming substrate 424 and first and second heaters 426, 427 are all substantially flat and substantially parallel to each other. The contact surfaces between any two of these components 420 are substantially planar and substantially parallel with each other.

The intermediate layer 423 has a cavity 434 extending through its thickness, the bottom of which is closed by the first heater 426. The aerosol-forming substrate 424 is held in the cavity 434. In this example, the cavity 434 is substantially rectangular and arranged with its long sides substantially parallel to the longitudinal axis of the cartridge 420.

The aerosol-forming substrate 424 comprises a tobacco-containing material with volatile flavour compounds which are releasable upon heating by the first and second heaters 426, 427. In this example, the aerosol-forming substrate is a substantially flat rectangular block of tobacco cast leaf.

The first and second heaters 426, 427 each comprise a plurality of heating elements 436 connected to electrical contacts 438. In this example, the heaters 426, 427 are each formed by disposing electrical contacts 438 and heating elements 436 on an electrically insulating substrate foil 437. Each electrically insulating substrate foil 437 is sized to extend across the width and length of each cavity 434. The first and second heaters 426 thus close off the top and bottom of the cavity 434 and help to keep the aerosol-forming substrate 424 within the cavity 434. The aerosol-forming substrate 424 can be held tightly within the cavity 434 by ensuring that the thickness of the base layer 422 is substantially the same as that of the aerosol-forming substrate.

The electric contacts 438 extend along a side edge of the electrically insulating substrate foil 437. The electric contacts of the first heater are accessible from outside of the cartridge from underneath and the electric contacts of the second heater are accessible from outside of the cartridge from above. The electrically insulating substrate foil 437 of one or both of the first and second heaters 426, 427 is perforated to allow aerosol released by the aerosol-forming substrate 424 to pass through the first and second heaters 426, 427. Although the heaters 426, 427 are described as being perforated, one or both could instead include one or more gas permeable windows. It will be apparent that it is sufficient for only one of heaters 426, 427 to be permeable to aerosol.

During use, the cartridge 420 is inserted into an aerosol-generating device, as shown in FIGS. 1A and 1B, so that the electrical contacts 438 connect with the corresponding electrical contacts in the cavity of the device. Electrical power is then provided by the device to the first and second heaters 426 to release aerosol from the aerosol-forming substrate. When a user sucks or puffs on the mouthpiece portion of the device, air is drawn from the air inlets in the mouthpiece, through the mouthpiece portion, where it is mixed with the aerosol. The air and aerosol mixture is then drawn through the outlet of the mouthpiece portion.

Once the aerosol-forming substrate 424 has been consumed by a user, the cartridge is removed from the cavity of the device and replaced.

Figure 5:
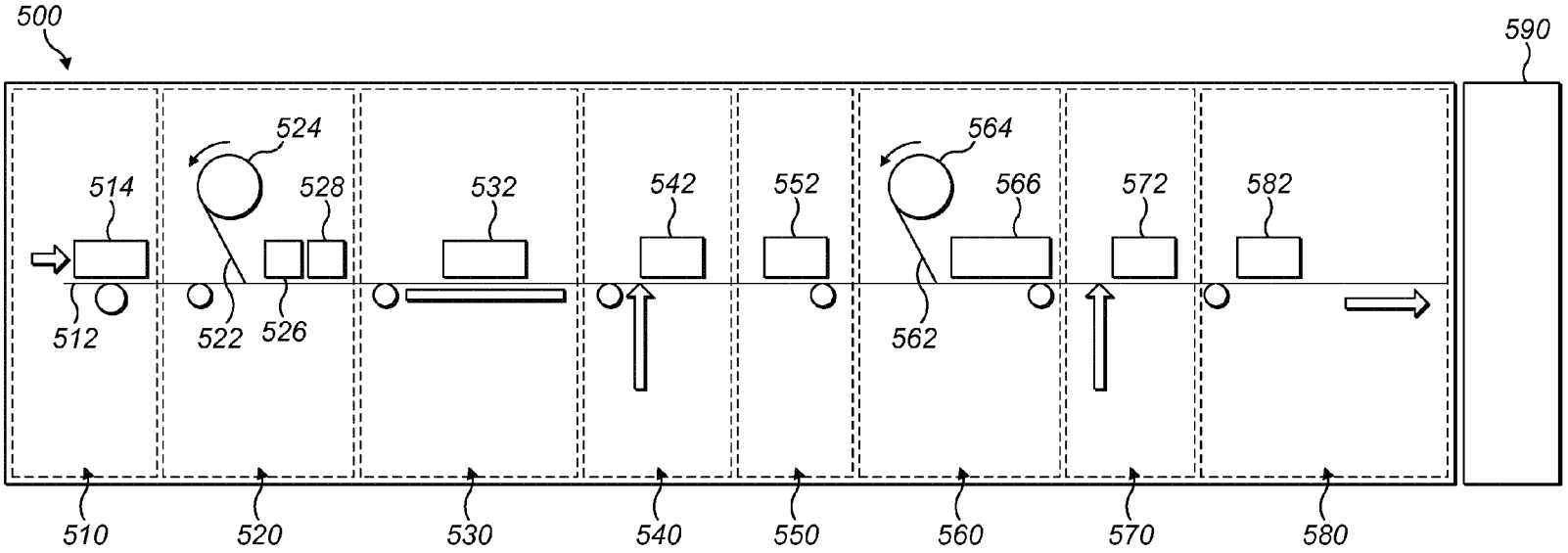
FIG. 5 shows a schematic illustration of a manufacturing process for making the aerosol-forming cartridge of FIGS. 2A and 2B.
Figure 6:
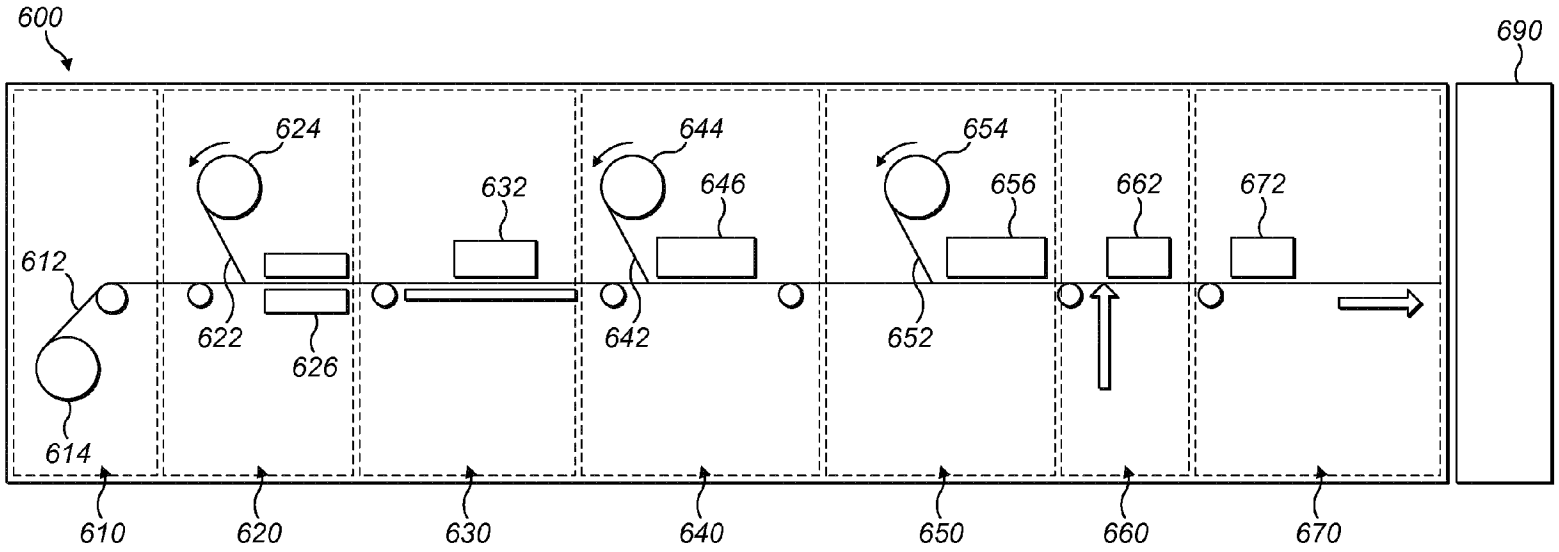
FIG. 6 shows a schematic illustration of a manufacturing process for making the aerosol-forming cartridge of FIGS. 3A and 3B.

FIGS. 5 and 6 show schematic illustrations of manufacturing processes for making the aerosol-forming cartridges of FIGS. 2A, 2B and 3A, 3B. In both of the processes described, the cartridges are assembled "vertically" at a number of different stations along an assembly line as a stream of cartridge components is conveyed along the assembly line. The term "manufactured vertically", refers to the fact that the cartridge components are placed on each other in the vertical direction and in sequence to build the cartridge up as it travels along the conveyor, generally starting with the lowermost element and placing subsequent elements on top to end with the uppermost element of the cartridge. The contact surfaces between adjacent components are substantially planar and substantially parallel. With this approach, only vertical assembly operations are required. Thus, there is no need for any more complex assembly operations, such as rotational or multi-translational movements when forming the cartridges.

FIG. 5 shows a schematic illustration of a manufacturing process for making the aerosol-forming cartridge 220 of FIGS. 2A and 2B using an assembly line 500 having a number of different stations.

At a first station 510, individual, injection-moulded base layers 222 are fed, as indicated by the arrow, onto a conveyor 512 by a first automated placement device 514, such as a pick and place machine. The conveyor 512 is a continuous belt with a plurality of cavities (not shown) on its top surface for receiving the base layers and ensuring correct placement of the base layers on the conveyor 512. The cavities may be arranged in a grid and the first automated placement device 514 may be arranged to pick up and place a plurality of base layers in the cavities in one operation so that multiple cartridges can be produced simultaneously. The following description of the process refers to the manufacture of an individual cartridge, although it could apply to multiple cartridges.

At a second station 520, a web of electric heater foil 522 is fed from a bobbin 524 to the conveyor 512 and an individual electric heater 226 is cut from the web of foil by a cutting device 526 and placed in the cavity 234 on the top surface of the base layer by a second automated placement device 528. During this step, the electric heater is placed so that its electrical contacts 238 are in line with the contact apertures 240 in the base layer. In this example, the web of electric heater foil comprises an electrically conductive foil, such as stainless steel, which is stamped by the cutting device 526 to form the electric heating elements 236 and electric contacts 238.

At a third station 530, the aerosol-forming substrate 224 is fed to the conveyor 512 and placed in the cavity 234 on the top surface of the base layer 222 and on top of the electric heater 226 by a third automated placement device 532, such as a pick and place machine. In this example, the aerosol-forming substrate comprises a solid substrate. In examples where the aerosol-forming substrate comprises a liquid substrate absorbed in a porous carrier, the porous carrier is first placed in the cavity by the third automated placement device 532 and the liquid substrate is then dispensed onto the porous carrier using an automated vertical dosing and filling apparatus (not shown).

At a fourth station 540, an injection-moulded cover layer 228 is fed to the conveyor 512 and placed over the base layer 222, the aerosol-forming substrate 224 and the electric heater 226 by a fourth automated placement device 542. Preferably, the cover layer is placed on the base layer so that at least part of its gas permeable window 242 is above at least part of the electric heater to improve a flow of aerosol through the gas permeable window during use of the cartridge.

At a fifth station 550, the cover layer 228 is welded to the base layer 222 using a first automated ultrasonic welding device 552.

At a sixth station 560, a web of protective foil 562 is fed from a bobbin 564 to the conveyor 512 and an individual protective foil 230 is cut from the web of protective foil. The protective foil is applied over the cover layer 228 so that the tab 248 extends in the opposite direction to that of the assembled cartridge, that is, in the direction of the end of the cartridge 220 at which the electrical contacts 640 are located. The protective foil is removably attached to the cover layer by ultrasonic welding to form a continuous sealing line around the gas permeable window 242 of the cover layer and the protective foil is then folded back on itself along a transverse fold line 249 so that the tab extends beyond the cover layer in the direction shown in FIG. 2A.

The cutting, welding and folding steps can be carried out by a single machine 566 or by two or more separate devices.

At a seventh station 570, an injection-moulded top cover 232 is fed, as indicated by the arrow, to the conveyor 512 by a seventh automated placement device 572, such as a pick and place machine.

At an eighth station 580, the top cover 232 is welded to the cover layer 228 by a second automated ultrasonic welding device 582 to complete the assembly of the cartridge.

The completed cartridge is then conveyed to a packer 590, where it is combined with other completed cartridges and packaged for sale.

FIG. 6 shows a schematic illustration of a manufacturing process for making the aerosol-forming cartridge 320 of FIGS. 3A and 3B using an assembly line 600 having a number of different stations. Ata first station 610, a web of electric heater foil 612 is fed from a bobbin 614 to the assembly line. The web of electric heater foil 612 comprises an electrically insulating substrate on which a plurality of electric heating elements and electrical contacts are disposed so that the web of electric heater foil 612 may be cut to form individual electric heaters for individual cartridges. The web of electric heater foil 612 may have a width that is several multiples of that of each completed cartridge so that multiple cartridges can be manufactured simultaneously.

At a second station 620, a web of intermediate layer foil 622 is fed from a bobbin 624 to the assembly line and over the electric heater foil 612. The web of intermediate layer foil 622 and the electric heater foil 612 are laminated together by a first laminating device 626 to form a web of base layer foil 628. In this example, the web of intermediate layer foil 622 and the web of electric heater foil 612 are pressed together and heated in the first laminating device 626 so that the two webs fuse together, although any other suitable laminating process may be used. In this example, the web of intermediate layer foil 622 is pre-cut with a plurality of apertures for forming the cavities 334 in each intermediate layer 323 before winding on the bobbin 624, although the apertures could be cut after unwinding form the bobbin 624 by a cutting device (not shown) positioned between the bobbin 624 and the first laminating device 626.

At a third station 630, the aerosol-forming substrates 324 are fed to the base layer foil 628 and placed in the cavities 334 in the base layer foil 628 by a first automated placement device 632, such as a pick and place machine. In alternative embodiments in which the aerosol-forming substrate comprise a slurry, a thin shield layer, which also has a plurality of apertures corresponding to the apertures in the intermediate layer foil 622, may be removably attached to the upper surface of the web of intermediate layer foil 622, for example using adhesive. After the slurries are dispensed into the cavities 334 by the first automated placement device, which in this case may be an automated vertical dosing and filling apparatus (not shown), the shield layer is removed from the intermediate layer foil 622 to reveal a clean upper surface for subsequent process steps. In alternative embodiments in which the aerosol-forming substrates comprise a liquid substrate absorbed in a porous carrier, the porous carrier is first placed in the cavity by the first automated placement device 632 and the liquid substrate is then applied to the porous carrier using an automated vertical dosing and filling apparatus (not shown) positioned after the first automated placement device 632.

At a fourth station 640, a web of cover layer foil 642 is fed from a bobbin 644 to the assembly line and over the base layer foil 628. The web of cover layer foil 642 and the web of base layer foil 628 are laminated together by a second laminating device 646. In this example, the web of base layer foil 628 and the web of cover layer foil 642 are pressed together and heated in the second laminating device 646 so that the two webs fuse together, although any other suitable laminating process may be used. The web of cover layer foil 642 comprises a polymeric foil with a plurality of pre-formed grids for forming the gas permeable window 342 in the cover layer 328 of each cartridge 320.

At a fifth station 650, a web of protective foil 652 is fed from a bobbin 654 to the assembly line and over the web of cover layer foil 642. The web of protective foil 652 is pre-cut so that individual protective foils 330 can be separated from the web of protective foil 652. Individual protective foils 330 are applied over the web of cover layer foil 642 so that their respective tabs 348 extend in the opposite direction to that of the assembled cartridge, that is, in the direction of the upstream end of the cartridge 320 at which the air inlets 350 will be located. Each protective foil 330 is removably attached to the cover layer foil 642 by ultrasonic welding to form a continuous sealing line around a gas permeable window 342 in the cover layer foil 642 and is folded back on itself along a transverse fold line 349 so that the tab 348 extends in the upstream direction, that is, in the direction in which it extends in FIG. 3A. The cutting, welding and folding steps can be carried out by a single machine 656 or by two or more separate devices.

At a sixth station 660, an injection-moulded top cover 332 is fed to the assembly line and over the protective foil 330 by a second automated placement device 662, such as a pick and place machine.

At a seventh station 670, the top cover 332 is welded to the cover layer 328 by an automated ultrasonic welding device 672 to complete the assembly of the cartridge.

The completed cartridge is then conveyed to a packer 690, where it is combined with other completed cartridges and packaged for sale.

In each of the above described processes, any two or more of the foil webs may be indexed to ensure precise relative positioning of the various components of each cartridge. For example, the foil webs may have perforated edges by which they are indexed.

The exemplary embodiments described above illustrate but are not limiting. In view of the above discussed exemplary embodiments, other embodiments consistent with the above exemplary embodiments will now be apparent to one of ordinary skill in the art.

The invention claimed is:

1. An aerosol-forming cartridge for an electrically operated aerosol-generating system, the cartridge comprising:

a base layer; and at least one aerosol-forming substrate disposed on the base layer and comprising a tobacco-containing material with volatile tobacco flavour compounds that are releasable from the at least one aerosol-forming substrate, wherein the base layer and the at least one aerosol-forming substrate are in contact at a first contact surface, which is substantially planar.

2. The aerosol-forming cartridge of claim 1, wherein one or both of the base layer and the at least one aerosol-forming substrate is substantially flat.

3. The aerosol-forming cartridge of claim 1, wherein the base layer comprises at least one cavity, and wherein the at least one aerosol-forming substrate is held in the at least one cavity.

4. The aerosol-forming cartridge of claim 1, wherein the at least one aerosol-forming substrate comprises a plurality of aerosol-forming substrates disposed separately on the base layer.

5. The aerosol-forming cartridge of claim 4, wherein the base layer comprises a plurality of cavities, and wherein each of the plurality of aerosol-forming substrates is held in a cavity of the plurality of cavities.

6. The aerosol-forming cartridge of claim 1, further comprising an electric heater including at least one heating element configured to heat the at least one aerosol-forming substrate, wherein a second contact surface between the electric heater and one or both of the base layer and the at least one aerosol-forming substrate is substantially planar and substantially parallel to the first contact surface between the base layer and the at least one aerosol-forming substrate.

7. The aerosol-forming cartridge of claim 6, wherein the at least one aerosol-forming substrate comprises a plurality of aerosol-forming substrates disposed separately on the base layer, and wherein the electric heater comprises a plurality of heating elements each configured to heat a different one of the plurality of aerosol-forming substrates.

8. The aerosol-forming cartridge of claim 1, further comprising an integral mouthpiece portion.

9. The aerosol-forming cartridge of claim 8, wherein the cartridge is configured such that a resistance-to-draw at a downstream end of the mouthpiece portion is from about 50 mmWG to about 130 mmWG.

10. The aerosol-forming cartridge of claim 8, wherein the cartridge is configured such that a resistance-to-draw at a downstream end of the mouthpiece portion is from about 95 mmWG to about 105 mmWG.

11. An electrically operated aerosol-forming system, comprising:

an aerosol-forming cartridge comprising:

a base layer, and at least one aerosol-forming substrate disposed on the base layer and comprising a tobacco-containing material with volatile tobacco flavour compounds that are releasable from the at least one aerosol-forming substrate, wherein the base layer and the at least one aerosol-forming substrate are in contact at a first contact surface, which is substantially planar;

an electric vaporiser configured to vaporise the at least one aerosol-forming substrate; and an aerosol-generating device comprising:

a main body defining a slot-shaped receptacle configured to removably receive the aerosol-forming cartridge, and an electric power supply configured to supply power to the electric vaporiser.

12. A method of manufacturing an aerosol-forming cartridge for an electrically operated aerosol-generating system, the method comprising:

providing a base layer; and placing at least one aerosol-forming substrate on the base layer such that the base layer and the at least one aerosol-forming substrate are joined at a first contact surface, which is substantially planar, wherein the at least one aerosol-forming substrate comprises a tobacco-containing material with volatile tobacco flavour compounds, which are released from the at least one aerosol-forming substrate upon heating.

13. The method of claim 12, further comprising forming at least one cavity in the base layer, wherein the placing the at least one aerosol-forming substrate on the base layer further comprises placing the at least one aerosol-forming substrate in the at least one cavity.

14. The method of claim 12, wherein the providing the base layer comprises feeding a web of base layer foil from a bobbin to an assembly line and cutting the web of base layer foil transversely to form individual base layers.

15. The method of claim 12, further comprising attaching an electric heater to the base layer such that the electric heater and the base layer are in contact at a second contact surface, which is substantially planar and is substantially parallel to the first contact surface between the base layer and the at least one aerosol-forming substrate.

16. The method of claim 15, wherein the attaching the electric heater comprises feeding a web of electric heater foil from a bobbin to an assembly line and cutting the web of electric heater foil transversely to form individual electric heaters.

17. The method of claim 16, further comprising forming a plurality of aerosol-forming cartridges in parallel, wherein the web of electric heater foil has a width from about two times to about 50 times greater than a width of each aerosol-forming cartridge of the plurality of aerosol-forming cartridges.

18. The method of claim 16, wherein two or more webs of foil from which the aerosol-forming cartridge is made are laminated together.

19. The method of claim 16, wherein the web of electric heater foil comprises a web of electrically insulating substrate foil to which a plurality of heating elements is attached.

20. The method of claim 19, further comprising forming a plurality of aerosol-forming cartridges in parallel, wherein the web of base layer foil has a width from about two times to about 50 times greater than a width of each aerosol-forming cartridge of the plurality of aerosol-forming cartridges.

* * * * *